US012302967B1

(12) United States Patent
Gueritee et al.

(10) Patent No.: US 12,302,967 B1
(45) Date of Patent: May 20, 2025

(54) TEXTILE ELEMENT SUCH AS A CLOTHING

(71) Applicant: CLIM8, Limonest (FR)

(72) Inventors: Julien Gueritee, Eveux (FR); Florian Miguet, Venissieux (FR)

(73) Assignee: CLIM8 (FR)

( * ) Notice: Subject to any disclaimer, the term of this patent is extended or adjusted under 35 U.S.C. 154(b) by 0 days.

(21) Appl. No.: 18/823,961

(22) Filed: Sep. 4, 2024

(51) Int. Cl.
*G08B 23/00* (2006.01)
*A41D 13/005* (2006.01)
*A41D 27/00* (2006.01)

(52) U.S. Cl.
CPC ..... *A41D 27/00* (2013.01); *A41D 13/005* (2013.01)

(58) Field of Classification Search
CPC ..... A41D 27/00; A41D 13/005
See application file for complete search history.

(56) References Cited

U.S. PATENT DOCUMENTS 9,253,884 B2 * 2/2016 Jezewski ..... H05K 1/028
9,271,665 B2 * 3/2016 Sarrafzadeh ..... A61B 5/4561
9,817,440 B2 * 11/2017 Longinotti-Buitoni ..... D06M 23/16
10,254,492 B2 4/2019 Wang et al.
2017/0215495 A1 8/2017 Okumiya et al.
2019/0269180 A1 9/2019 Desmeules
2022/0087344 A1 * 3/2022 Gueritee ..... A41D 19/01541

FOREIGN PATENT DOCUMENTS

CN 204259897 U 4/2015
EP 3182254 A2 6/2017
KR 200411160 Y1 3/2006
WO 2014188350 A1 11/2014

* cited by examiner

*Primary Examiner* — Toan N Pham
(74) *Attorney, Agent, or Firm* — Dhiraj Jindal; PATENT YOGI LLC

(57) ABSTRACT

The invention relates to a textile element, such as a clothing, aimed at covering a part of a body, such as a human body, with a particular application to a clothing for generating a physical effect, such as heat or cold, to the part of the body. The textile element forms an envelope aimed at covering at least partially a part of a body, said textile element comprising a control unit powered by a power source, a textile support, and body part detection means located on or in said textile support and configured to detect the presence and/or absence of said part of a body inside the envelope and to generate a detection signal when presence and/or absence of said part of a body inside the envelope is detected, said body part detection means being adapted for being connected, and for transmitting the detection signal, to said control unit.

14 Claims, 2 Drawing Sheets

TEXTILE ELEMENT SUCH AS A CLOTHING

Figure 1A:
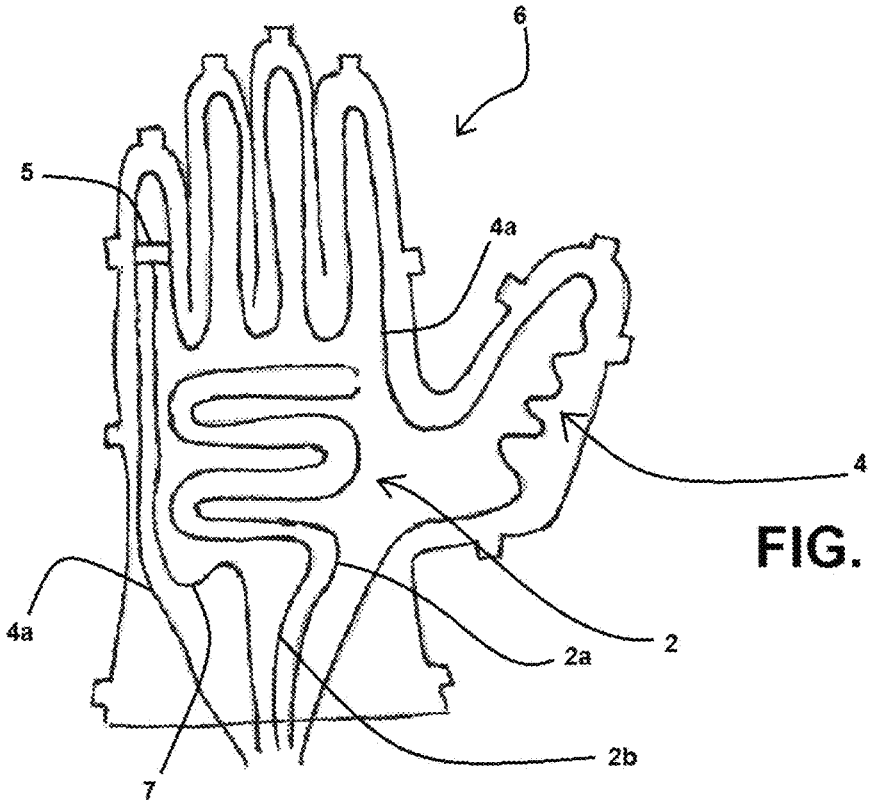

This application claims the benefit of Foreign Patent Application No. EP24189930, titled "A TEXTILE ELEMENT SUCH AS A CLOTHING", filed on 21 Jul. 2024, which is incorporated by reference herein in its entirety.

FIELD OF THE INVENTION

The present invention relates to a textile element, such as a clothing, aimed at covering a part of a body, such as a human body, with a particular application to a clothing for generating a physical effect, such as heat or cold, to the part of the body.

BACKGROUND OF THE INVENTION

Thermal comfort is driven by the temperature inside a person's body and the temperature at the surface of your body. Deep body temperature of a person is generally 37° C. and the mean skin temperature of a person is generally 33° C. People become uncomfortable in a thermal sense when the environment changes for example, increased wind or extra sunny day, or when a person moves to a cooler place. In common situations, discomfort in a thermal sense is felt by a user when the user's skin temperature changes, rather than a change in core body temperature.

Conventional chemical or electric heating systems used in clothing can easily deliver heat at relatively high levels. Most currently available devices consist of a wearable garment with heating pads that can be manually adjusted by the user. In at least some devices the heating pads produce an equal heat output and all the heating pads are activated to provide heat.

Let us consider the example of a warming glove with a heating element activated when a sensed temperature falls below a determined threshold. If the glove is connected to its external power source, and the conditions for triggering the heating are met, the heating element will be activated even if it is not worn by a user. For example, when the glove is stored in a room which is not heated, and still connected to its external power source because the user has forgotten to disconnect it, the heating element could be automatically activated, depending on the ambient temperature, which leads to unloading of the power source.

This problem could be solved by integrating to the glove a manual on/off button. Still, the user might forget to switch the glove off. Besides, the user has to think of switching the glove on again the next time he/she wears the glove. On top of this, integration of such a button in the glove has ergonomic consequences for the user.

In other applications, some other actions should be authorized only when the hand of the user is inserted into the glove, for example for safety reason. This is the case with some dangerous tools, which should not be used by a user if the latter does not wear protective gloves.

SUMMARY OF THE INVENTION

The invention aims therefore at solving the problems mentioned, amongst other problems.

To this end, the invention proposes a textile element forming an envelope aimed at covering at least partially a part of a body, which is able to determine when the part of a body is inserted into the envelope.

According to a first aspect, the object of the invention is a textile element forming an envelope aimed at covering at least partially a part of a body, said textile element comprising a control unit powered by a power source, a textile support, and body part detection means located on or in said textile support and configured to detect the presence and/or absence of said part of a body inside the envelope and generate a detection signal when presence and/or absence of said part of a body inside the envelope is detected, said body part detection means being adapted for being connected, and for transmitting the detection signal, to said control unit.

An active element adapted for generating a physical effect, such as heat or cold, is located on or in the textile support and adapted for being connected to the power source and the control unit.

The control unit is configured to allow the activation/deactivation of said active element depending on the detection signal transmitted by the body part detection means.

The body part detection means further comprise a first and a second distinct sensing elements each of an electric capacitive accumulation type, the controlling unit being connected to the first and second sensing elements and configured to receive one or more sensed information from the first and second sensing elements and to determine one or more sensed values from said one or more sensed information.

The controlling is further configured to:

- receive a first sensed information from the first sensing element, determine from the first sensed information a first sensed value, activate the active element when the first sensed value is greater than a predetermined first activation value and deactivate the active element when the first sensed value is smaller than a predetermined first deactivation value;
- receive a second sensed information from the second sensing element, determine from the second sensed information a second sensed value, activate the active element when the second sensed value is greater than a predetermined second activation value and deactivate the active element when the second sensed value is smaller than a predetermined second deactivation value;
- receive a third sensed information from the second sensing element, determine from the third sensed information a third sensed value, deactivate the active element when the difference between the second sensed value and the third sensed value is greater or equal to a predetermined third deactivation value;
- every t seconds, t>0, receive a fourth sensed information from the second sensing element, determine from the fourth sensed information a fourth sensed value, reset the second sensing element when the fourth sensed value is comprised in a predetermined interval of values.

In some embodiments, the textile element further comprises one or more of the following features, considered alone or according to any technically possible combination:

- the control unit comprises an interface adapted to receive from an external device and/or as a manual input, at least one of: the first and second activation values, the first, second and third deactivation values, and the lower and upper limits of the interval of values;
- the control unit is configured to determine a sensed value of the digital type from a sensed information of the analog type received from the first or second sensing element, based on at least one of the three parameters:
  - time offset, corresponding to a time shift of reading of an analog sensed information by the control unit, such that the control unit is adapted for periodically receiving an analog sensed information from the first or second sensing element at a given frequency, plus a time corresponding to the time offset, analog gain, corresponding to a multiplier of an analog sensed information, such that the control unit is adapted for adjusting an analog sensed information by multiplying or dividing it by the analog gain, digital gain, corresponding to a multiplier of a digital sensed value, such that the control unit is adapted for adjusting an digital sensed value by multiplying or dividing it by the analog gain;

the control unit comprises an interface adapted to receive from an external device and/or as a manual input, at least one of: the time offset, the analog gain, and the digital gain;

the first and second sensing elements are disposed on or in the textile support such as to form respectively a first sensing path and a second sensing paths running through predetermined points of the textile element and aiming at being in contact with, or in the vicinity of, corresponding predetermined points of the part of a body;

the length of each of the first and second sensing paths is sensibly greater or equal to 10 cm;

the first sensing path never touches or crosses the second sensing path;

the active element is disposed on or in the textile support such as to form an active path running through predetermined points of the textile element and aiming at being in contact with, or in the vicinity of, corresponding predetermined points of the part of a body, and wherein the first and second sensing paths never touches or crosses the active path;

the texile element comprise a sensor for sensing the physical effet generated by the active element, located on or in the textile support and connected to the control unit through a connection element, wherein the connection element is disposed on or in the textile support such as to form a connection path running through predetermined points of the textile element, and wherein the first and second sensing paths never touches or crosses the connection path;

the part of the body is a hand and the textile element is a glove, the first and second sensing paths runing through the corresponding predetermined points of the glove so as to be in contact with, or in the vicinity of, the back of the hand of a user wearing the glove;

the part of the body is a hand and the textile element is a glove, at least one of the first and second sensing paths running through the corresponding predetermined points of the glove such as to go from the area connecting the hand and the wrist of a user wearing the glove to one finger of the hand of a user wearing the glove;

the part of the body is a hand and the textile element is a glove, at least one of the first and second sensing paths running through the corresponding predetermined points of the glove such as to form two meandering parallel paths going from the area connecting the hand and the wrist of a user wearing the glove to the area connecting the fingers to the metacarpal part of the hand of a user wearing the glove;

the body is a human body, and the textile element is a clothing configured to receive at least a part of said body;

the body is a hand and the clothing is a glove, or the part of the body is a foot and the clothing is a sock or a shoe, or the part of the body is the head and the clothing is a cap or a helmet.

Such a textile element allows therefore the reliable determination of the presence and/or absence of the part of a body inside the envelope. This allows in turn, for example in the application of a heating glove mentioned above, to save energy from the power source by not activating uselessly the heating without requiring a manual intervention from the user. This allows too, in other applications, to prevent a user to make an action when he/she does not wear the glove.

DRAWINGS

Figure 1B:
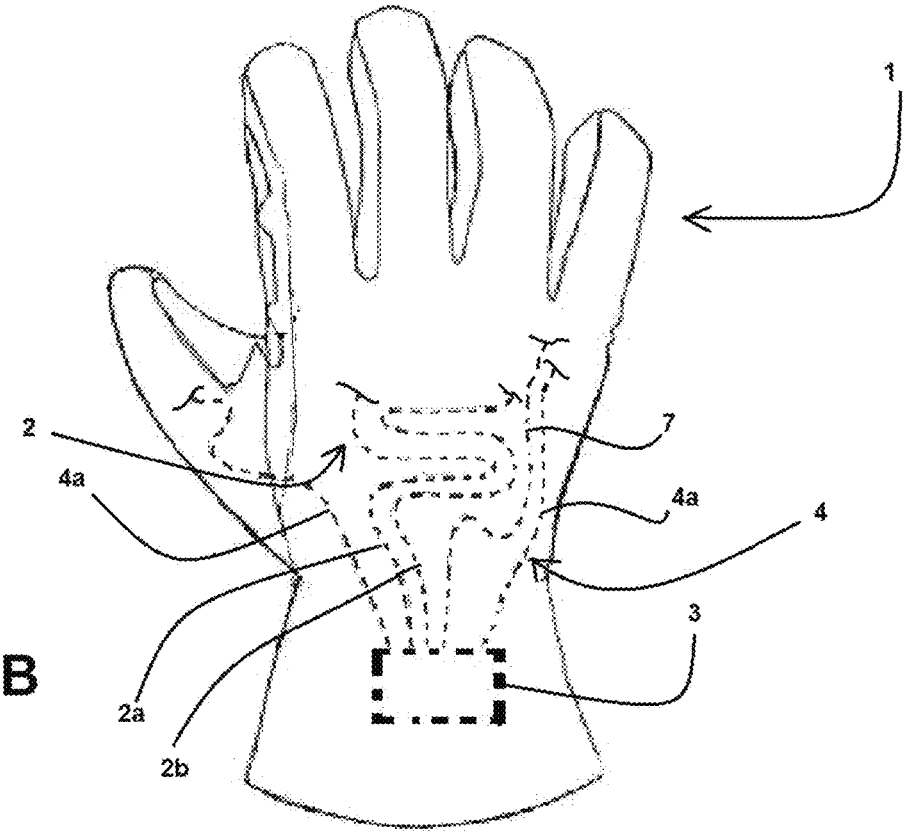
Figure 2A:
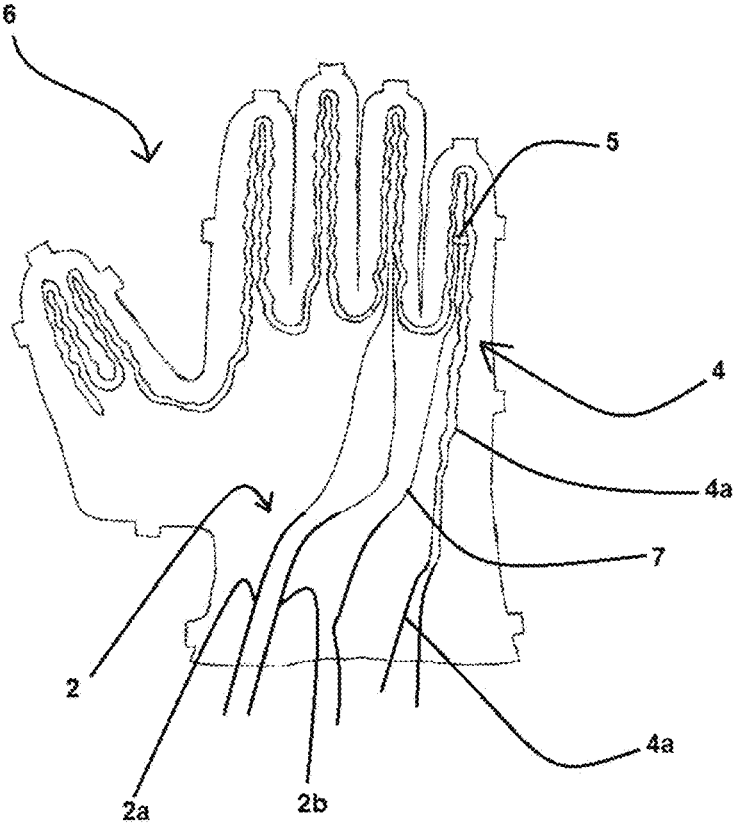
Figure 2B:
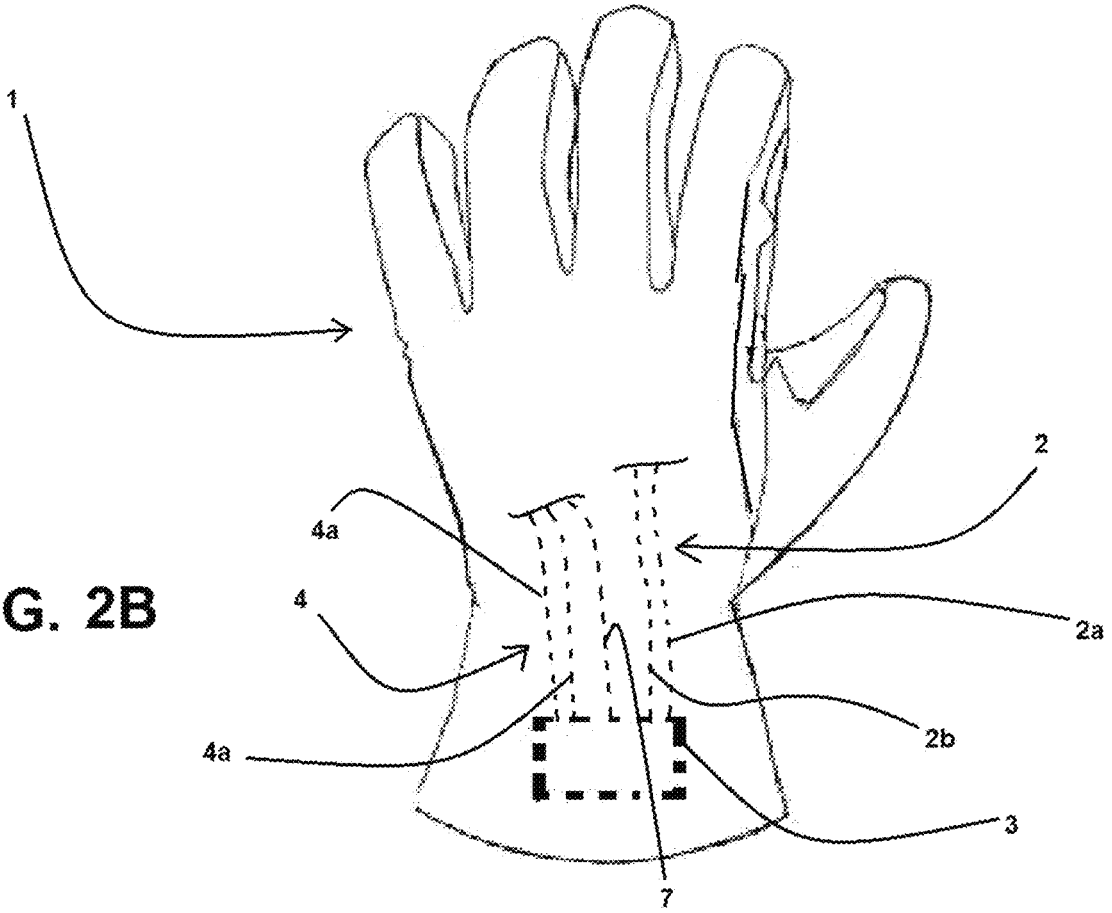

The invention and its advantages may be better understood by referring to the description which follows, given as example and for illustrative purpose only, and by referring to:

FIGS. 1A, 1B: which show an example of a textile support (FIG. 1A) and of a textile element (FIG. 1B) comprising the textile support, according to the invention, namely a right glove of a pair of gloves;

FIGS. 2A, 2B: which show an example of a textile support (FIG. 2A) and of a textile element (FIG. 2B) comprising the textile support, according to the invention, namely a left glove of a pair of gloves.

DETAILED DESCRIPTION

FIGS. 1A, 1B, 2A, 3B illustrate examples of application of the invention to the technical field of clothing. More specifically, these examples deal with the application where the textile element 1 is a glove, and the part of a body is the hand of a user.

The glove 1 forms an envelope 1 which aims at covering totally or partially the hand of a user.

Detection means 2 are integrated into the glove 1, more specifically into a textile support 6 of this glove 1. This means that the glove 1 can be made of one or more textile layer, one of which being said textile support 6. Integration of the detection means 2 into the textile support means that these detection means are located on or in the textile support, for example by knitting, stitching and/or thermal bonding.

As it is preferable to position the detection means as close as possible to the part of the body to be detected, in the case of a glove 1, the textile support 6 is adapted for being positioned at the top of the glove 1, facing the interior of the glove. Therefore, the right part and left part of the textile support 6 of FIG. 1A corresponds respectively to the left par and the right part of the glove 1 of FIG. 1B. The same applies to FIGS. 2A and 2B: the right part and left part of the textile support 6 of FIG. 2A corresponds respectively to the left par and the right part of the glove 1 of FIG. 2B.

The hand detection means 2 are configured to detect the presence and/or absence of the hand of a user inside the envelope formed by the glove 1, and to generate a detection signal when such presence and/or absence of the hand inside the envelope 1 is detected. These hand detection means 2 are adapted for being connected, and for transmitting the detection signal, to a control unit 3 powered by a power source.

By presence and/or absence of the hand respectively in and/or from the glove, it may be understood entering and/or retrieving the hand respectively in and/or from the glove. In such a case, the detection means 2 are configured to detect the hand entering inside, and/or going out of, the envelope formed by the glove 1. This means that the detection of presence may take place at one specific moment of the phase of inserting the hand into the glove depending on calibration and presetting, not necessarily when the hand is fully inserted into the glove. Similarly, the detection of absence may take place at one specific moment of the phase of retrieving the hand out of the glove depending on calibration and presetting, not necessarily when the hand is fully retrieved out of the glove.

The textile element, such as the glove 1 of FIGS. 1B, 2B, is an active textile element. Such an active textile element comprises an active element 4 adapted for generating a physical effect, such as heat or cold. This active element 4 is located on or in the textile support 6, and is adapted for being connected to the power source and the control unit 3 powered by the power source, the control unit being configured to allow the activation/deactivation of said active element 4, depending on the detection signal transmitted by the body part detection means 2.

Such an example of configuration of a textile element with an active element adapted for generating heat when powered by a power source and under control of a control unit, is described in WO2018214088 or WO2017162131.

The body part detection means 2 are adapted for being connected, and for transmitting the detection signal, to the control unit 3, such as to allow the control unit to activate/deactivate the active element 4 when receiving the detection signal.

Therefore, in the specific embodiment of a heating glove 1, the detection of the hand inserted into, or retrieved from, the glove 1, allows to automatically activate, or deactivate, the heating element 4, through the controlling unit 3 which receives the detection signal from the detection means 2.

Whether in the embodiment of a heating glove or in other embodiments, the hand detection means 2 more precisely comprise first and second sensing elements 2*a*, 2*b*.

The sensing elements 2*a*, 2*b* are adapted for sensing physical information related to the presence and/or the absence of the hand inside the envelope 1 by the. glove. More precisely, the first and second sensing elements 2*a*, 2*b* are both of an electric capacitive accumulation type The controlling unit 3, or controller 3, is connected to these sensing elements 2*a*, 2*b*. and configured to receive one or more sensed information from the sensing elements 2*a*, 2*b* and to determine one or more sense values from the one or more sensed information.

The information sensed by the sensing elements is for example an information related to the contact of the hand with the sensing elements 2*a*, 2*b* or related to the hand coming in a determined vicinity of the sensing elements 2*a*, 2*b*.

The controller 3 is configured to detect an electric field generated when the hand comes in contact with, or in a vicinity of, the capacitive sensing elements 2*a*, 2*b*.

In the example of the figures, the capacitive sensing elements 2*a*, 2*b* are are electrically conductive elements 2*a*, 2*b*. These conductive elements 2*a*, 2*b* can be conducting wires, such as represented in the figures, or plates in conductive material such as copper, directly located, or located via a support such as a PCB support, in or on the textile support.

The controller 3 is more precisely configured to receive a first sensed information from the first sensing element 2*a*, and then determine from the first sensed information a first sensed value. The controller 3 further activates the active element 4 when the first sensed value is greater than a predetermined first activation value, and deactivates the active element 4 when the first sensed value is smaller than a predetermined first deactivation value.

Therefore, the first sensing element 2 allows the detection of the hand of a user in the glove 1, by comparing the sensed value with a predetermined first activation value and first deactivation value, and in turn activation, respectively deactivation, of the active element 4. The first activation and deactivation values may be customized, depending on the textile element 1 (shape, size, structure) and/or depending on the profile of the user, and/or other factors.

The controller 3 is further configured to receive a second sensed information from the second sensing element 2*b*, and then determine from the second sensed information a second sensed value,. The controller 3 further activates the active element 4 when the second sensed value is greater than a predetermined second activation value, and deactivate the active element 4 when the second sensed value is smaller than a predetermined second deactivation value.

Therefore, the second sensing element 2*b* also allows the detection of the hand of a user in the glove 1, by comparing the sensed value with a predetermined second activation value and second deactivation value, and in turn activation, respectively deactivation, of the active element 4. The second activation and deactivation values may also be customized, depending on the textile element 1 (shape, size, structure) and/or depending on the profile of the user, and/or other factors.

Further, the controller 3 is configured to receive a third sensed information from the second sensing element 2*b*, and then determine from the third sensed information a third sensed value. The controller further deactivates the active element 4 when the difference between the second sensed value and the third sensed value is greater or equal to a predetermined third deactivation value.

The above is of particular importance in case of saturation of the first sensing element 2*a*. In that case, a fall of the information sensed by the second sensing element 2*b* compared to the second sensed information, which means than the third sensed information falls low compared to the second sensed information. In turn, the corresponding third sensed value determine by the controller 3 falls low compared to the second sensed value determined by the controller 3. In case such saturation is detected through the comparison with the thrid deactivation value, the controller 3 thus deactivates the active element 4. This third deactivation value may also be customized, depending on the textile element 1 (shape, size, structure) and/or depending on the profile of the user, and/or other factors.

Further, the controller 3 is configured to receive a fourth sensed information from the second sensing element 2*b*, in a periodic manner, meaning every t seconds, t being greater than 0 and being possibly customized. In a preferred embodiment, t is equal to 10 seconds. The controller 3 then determine from the fourth sensed information a fourth sensed value, and reset the second sensing element 2*b* when this fourth sensed value is comprised in a predetermined interval of values.

By resetting the second sensing element 2*b*, it is meant that the electrical capacity accumulated in this second sensing element 2*b* is reset to 0 by unloading the electrical capacity load accumulated.

The above is also of particular importance in case of saturation of the second sensing element 2*b*. To overcome the saturation, a periodic resetting of the second sensing element 2*b* is performed by the controller 3, when the fourth sensed value is comprised in the predetermined interval of values. This interval of values may also be customized, depending on the textile element 1 (shape, size, structure) and/or depending on the profile of the user, and/or other factors. Typically, the upper and lower limit of this interval are two customized values, possibly identical in absolute value in which case it is sufficient to customize the single corresponding absolute value.

In order to adjust one or more of the first and second activation values, the first, second and third deactivation values, and the lower and upper limits of the interval of values, the control unit 3 may comprise an interface adapted to receive from an external device and/or as a manual input, the corresponding values.

Preferably, the control unit 3 is configured to determine a sensed value of the digital type from a sensed information of the analog type received from the first or second sensing element 2*a*, 2*b*.

This determination of a digital sensed value from an analog sensed information may be based on at least one of the three following parameters: a time offset, an analog gain, a digital gain.

The time offset corresponds to a time shift of reading of an analog sensed information by the control unit 3. The control unit 3 is thus adapted for periodically receiving an analog sensed information from the first or second sensing element 2*a*, 2*b* at a given frequency plus a time corresponding to the time offset.

The analog gain corresponds to a multiplier of an analog sensed information read by the controller 3. The controller 3 is thus adapted for adjusting an analog sensed information by multiplying or dividing it by the analog gain, The digital gain corresponds to a multiplier of a digital sensed value. The controller 3 is thus adapted for adjusting an digital sensed value by multiplying or dividing it by the analog gain.

To allow adjustment of the above one or more of the parameters time offset, analog gain and the digital gain, an interface may be foreseen, which can or not be the same as the one mentioned above and used for adjusting the first and second activation values, the first, second and third deactivation values, and the lower and upper limits of the interval of values.

The sensing elements 2*a*, 2*b* are disposed on or in the textile support 6 such as to form twp sensing paths 2*a*, 2*b*,. More precisely, the two sensing paths 2*a*, 2*b* are disposed on or in the textile support 6 such as to form respectively a first sensing path 2*a* and a second sensing path 2*b* running through predetermined points of the textile element 1 and aiming at being in contact with, or in the vicinity of, corresponding predetermined points of the part of a body, in our examples of a right hand (FIGS. 1A, 1B) or of a left hand (FIGS. 2A, 2B) of a user.

Preferably, the length of each of the first and second sensing paths 2*a*, 2*b* is sensibly greater or equal to 10 cm.

For the sake of reliability of the detection, the first and second sensing paths 2*a*, 2*b* are disposed in such a manner that they never touche or cros each other.

As can be seen more precisely on FIGS. 1A, 2A, the active element 4 is disposed on or in the textile support 6 such as to form an active path 4*a* running through predetermined points of the textile element 1, and aiming at being in contact with, or in the vicinity of, corresponding predetermined points of the part of a body, in our examples of a right hand (FIGS. 1A, 1B) or of a left hand (FIGS. 2A, 2B) of a user.

As can be also seen on the figures, the first and second sensing paths 2*a*, 2*b* are disposed in such a manner that never touch or cross the active path 4*a*.

Preferably, the textile element 1 comprises a sensor 5 for sensing the physical effet generated by the active element 4. In case the active element 4 is a heating element 4, the sensor 5 is a temperature sensor 5.

This sensor 5 is located on or in the textile support 6 and connected to the control unit 3 through a connection element 7. This connection element 7 is disposed on or in the textile support 6 such as to form a connection path 7 running through predetermined points of the textile element 1. As can be seen on the figures, first and second sensing paths 2*a*, 2*b* are disposed in such a manner that never touch or cross the connection path 7.

In the example of a hand and a glove illustrated in FIGS. 1A, 1B, at least one, preferably the two, sensing paths 2*a*, 2*b* run through the corresponding predetermined points of the glove 1 such as to go from the area connecting the hand and the wrist of a user wearing the glove 1 to one finger of the hand of a user wearing the glove 1.

In the example of a hand and a glove illustrated in FIGS. 2A, 2B, at least one, preferably the two, sensing paths 2*a*, 2*b* run through the corresponding predetermined points of the glove 1 such as to form two meandering parallel paths going from the area connecting the hand and the wrist of a user wearing the glove 1 to the area connecting the fingers to the metacarpal part of the hand of a user wearing the glove 1.

One end of each of the wires 2*a*, 2*b* forming the sensing paths 2*a*, 2*b*, is free, and the other end is connected to the controller 3 (see FIGS. 1B, 2B), such as a microchip 3.

With capacitive detection means 2, in some situations, for example in case of high humidity rate, the detection can be disturbed, with increase of risk of false detection. In such a case, it can be advantageous to use a movement detection means also integrated into the glove, such as an accelerometer.

This movement detection means is adapted for being connected to a power source and the control unit mention previously regarding the embodiment of an active textile element with an active element such as a heating or cooling element.

This movement detection means is also adapted for transmitting a movement detection signal to the control unit, such as to allow the control unit to activate/deactivate the active element when receiving a movement detection signal.

In such a way, even if the main detection means is disturbed, for example because of a high humidity rate, a movement detected by the movement detection means, after a period of rest, can be interpreted such as to wake up the heating system. Similarly, a lack of movement detected by the movement detection means, after a period of activity, can be interpreted such as to stop the heating system.

In some embodiments, the textile element 1 forms an envelope 1 aimed at covering at least partially a part of a body, said textile element comprising a control unit powered by a power source, a textile support, and body part detection means 2 located on or in said textile support and configured to detect the presence and/or absence of said part of a body inside the envelope 1 and to generate a detection signal when presence and/or absence of said part of a body inside the envelope 1 is detected, said body part detection means 2 being adapted for being connected, and for transmitting the detection signal, to said control unit 3.

An active element 4 adapted for generating a physical effect, such as heat or cold, is located on or in the textile support and adapted for being connected to the power source and the control unit 3.

The body part detection means 2 comprise two distinct sensing elements 2*a*, 2*b* of an electric capacitive accumulation type, the controlling unit 3 being connected to the sensing elements 2*a*, 2*b* and configured to receive sensed information from the sensing elements 2*a*, 2*b* and to determine sensed values from said sensed information.

The above description has been directed to specific embodiments of this invention which is, however, not limited to these embodiments described for purpose of example only.

In particular, the invention is not limited to a textile element, or clothing, aiming at covering a part of a human body, but extends to a textile element aiming at covering a part of an animal body or any sort of non-living body.

In the case of a part of a human body, the invention is not limited to a glove, but extends to clothing of any sort aiming at covering at least partially said part of a human body, such as a sock or a schoe (the part of a body being then a foot), or a cap or a helmet (the part of a body being then the head).

Besides, the invention is not limited to any specific kind of sensing technology for detecting the presence and/or absence of the body part inside the envelope formed by the textile element. A preferred example is given in the description that is based on capacitive sensing means, but other types of sensing means could be envisaged, such as pressure sensing means, with pressure sensors arranged on one or more sensing path as described above.

The invention claimed is:

1. A textile element forming an envelope aimed at covering at least partially a part of a body, said textile element comprising a control unit powered by a power source, a textile support, body part detection located on or in said textile support and configured to detect a presence and absence, or the presence, or the absence, of said part of a body inside an envelope and generate a detection signal when presence and absence, or the presence, or the absence, of said part of the body inside the envelope is detected, said body part detection being adapted for being connected, and for transmitting the detection signal, to said control unit, an active element adapted for generating a physical effect, including heat or cold, located on or in the textile support and adapted for being connected to the power source and the control unit, the control unit being configured to allow an activation/deactivation of said active element depending on the detection signal transmitted by the body part detection, wherein the body part detection comprise a first and a second distinct sensing elements each of an electric capacitive accumulation type, the control unit being connected to the first and second sensing elements and configured to receive one or more sensed information from the first and second sensing elements and to determine one or more sensed values from said one or more sensed information, the control unit being further configured to:

receive a first sensed information from the first sensing element, determine from the first sensed information a first sensed value, activate the active element when the first sensed value is greater than a predetermined first activation value and deactivate the active element when the first sensed value is smaller than a predetermined first deactivation value;

receive a second sensed information from the second sensing element, determine from the second sensed information a second sensed value, activate the active element when the second sensed value is greater than a predetermined second activation value and deactivate the active element when the second sensed value is smaller than a predetermined second deactivation value;

receive a third sensed information from the second sensing element, determine from the third sensed information a third sensed value, deactivate the active element when the difference between the second sensed value and the third sensed value is greater or equal to a predetermined third deactivation value;

every t seconds, t>0, receive a fourth sensed information from the second sensing element, determine from the fourth sensed information a fourth sensed value, reset the second sensing element when the fourth sensed value is comprised in a predetermined interval of values.

2. The textile element according to claim 1, wherein the control unit comprises an interface adapted to receive from an external device and as a manual input, or from the external device, or from the manual input, at least one of: the first and second activation values, the first, second and third deactivation values, and a lower and upper limits of the interval of values.

3. The textile element according to claim 1, wherein the control unit is configured to determine a sensed value of a digital type from a sensed information of an analog type received from the first or second sensing element, based on at least one of the three parameters:

time offset, corresponding to a time shift of reading of an analog sensed information by the control unit, such that the control unit is adapted for periodically receiving an analog sensed information from the first or second sensing element at a given frequency, plus a time corresponding to the time offset, analog gain, corresponding to a multiplier of an analog sensed information, such that the control unit is adapted for adjusting an analog sensed information by multiplying or dividing it by the analog gain, digital gain, corresponding to a multiplier of a digital sensed value, such that the control unit is adapted for adjusting the digital sensed value by multiplying or dividing it by the analog gain.

4. The textile element according to claim 3, wherein the control unit comprises an interface adapted to receive from an external device and as a manual input, or from an external device, or from the manual input, at least one of: the time offset, the analog gain, and the digital gain.

5. The textile element according to claim 1, wherein the first and second sensing elements are disposed on or in the textile support to form respectively a first sensing path and a second sensing path running through predetermined points of the textile element and aiming at being in contact with, or in the vicinity of, corresponding predetermined points of the part of a body.

6. The textile element according to claim 5, wherein a length of each of the first and second sensing paths is sensibly greater or equal to 10 cm.

7. The textile element according to claim 5, wherein the first sensing path never touches or crosses the second sensing path.

8. The textile element according to claim 5, wherein the active element is disposed on or in the textile support to form an active path running through predetermined points of the textile element and aiming at being in contact with, or in the vicinity of, corresponding predetermined points of the part of a body, and wherein the first and second sensing paths never touch or cross the active path.

9. The textile element according to claim 5, further comprising a sensor for sensing a physical effect generated by the active element and connected to the control unit through a connection element, wherein the connection element is disposed on or in the textile support to form a connection path running through predetermined points of the textile element, and wherein the first and second sensing paths never touch or cross the connection path.

10. The textile element according to claim 1, the body being a human body, and the textile element being at least a part of a clothing configured to cover at least partially a part of said human body.

11. A textile element according to claim 10, wherein the part of the body is a hand and the clothing is a glove, or the part of the body is a foot and the clothing is a sock or a shoe, or the part of the body is the head and the clothing is a cap or a helmet.

12. The textile element according to claim 11, wherein the part of the body is a hand and the textile element is a glove, the first and second sensing paths runing through the corresponding predetermined points of the glove so as to be in contact with, or in the vicinity of, the back of the hand of a user wearing the glove.

13. The textile element according to claim 11, wherein the part of the body is a hand and the textile element is a glove, at least one of the first and second sensing paths running through the corresponding predetermined points of the glove to go from the area connecting the hand and the wrist of a user wearing the glove to one finger of the hand of the user wearing the glove.

14. The textile element according to claim 11, wherein the part of the body is a hand and the textile element is a glove, at least one of the first and second sensing paths running through the corresponding predetermined points of the glove to form two meandering parallel paths going from the area connecting the hand and the wrist of a user wearing the glove to the area connecting the fingers to the metacarpal part of the hand of the user wearing the glove.

* * * * *